US007875583B2

(12) United States Patent
Sarcinelli et al.

(10) Patent No.: US 7,875,583 B2
(45) Date of Patent: Jan. 25, 2011

(54) BLEACHING COMPOSITIONS

(75) Inventors: Luca Sarcinelli, Cerveteri (IT); Annabelle Mayeux, Pavona (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/811,079

(22) Filed: Jun. 8, 2007

(65) Prior Publication Data

US 2008/0172802 A1 Jul. 24, 2008

(30) Foreign Application Priority Data

Jun. 8, 2006 (EP) ..... 06115131

(51) Int. Cl.
*C11D 7/26* (2006.01)
*C11D 7/32* (2006.01)
*C11D 7/54* (2006.01)

(52) U.S. Cl. ..... 510/303; 510/337; 510/380; 510/504; 8/108.1; 8/137

(58) Field of Classification Search ..... 510/302, 510/303, 336, 337, 379, 380, 504
See application file for complete search history.

(56) References Cited

U.S. PATENT DOCUMENTS 4,659,802 A 4/1987 Rubingh et al.
5,174,927 A * 12/1992 Honsa
5,454,982 A * 10/1995 Murch et al.
2002/0004474 A1 1/2002 Price

FOREIGN PATENT DOCUMENTS

| | | | |
|---|---|---|---|
| EP | 0 111 965 | A2 | 6/1984 |
| EP | 0 839 903 | A1 | 5/1998 |
| EP | 1 291 410 | A1 | 3/2003 |
| WO | WO 97/42292 | A1 | 11/1997 |
| WO | WO 99/15617 | A1 | 4/1999 |

OTHER PUBLICATIONS

International Search Report, mailed Nov. 19, 2007, International Application No. PCT/IB2007/052111.

Kirk-Othmer Encyclopedia of Chemical Technology, vol. 2, Amine Oxides, pp. 469-471 and pp. 556-560, (Jan. 2004).

* cited by examiner

*Primary Examiner*—Gregory R Del Cotto
(74) *Attorney, Agent, or Firm*—Andrew J. Mueller; James F. McBride; Leonard W. Lewis

(57) ABSTRACT

The present invention relates to a composition suitable for treating soiled fabrics comprising a hypohalite bleach and a soil suspending agent selected from the group consisting of an ethoxylated diamine, an ethoxylated polyamine, an ethoxylated amine polymer and mixtures thereof.

10 Claims, No Drawings

BLEACHING COMPOSITIONS

FIELD OF THE INVENTION

The present invention relates to bleaching compositions, in particular to hypohalite bleaching compositions, suitable for use in various laundry applications.

BACKGROUND OF THE INVENTION

Bleaching compositions are well-known in the art. Amongst the different bleaching compositions available, those relying on bleaching by hypohalite bleaches, such as hypochlorite, are often preferred, mainly for performance reasons, especially at lower temperature.

However, there are some limitations to the convenience of hypochlorite bleaches. In particular, problems encountered with the use of hypohalite-based compositions, like hypochlorite-based compositions, are the resulting yellowing of the fabrics being bleached, which thus affects the whiteness performance. Furthermore, hypohalite based compositions are prone to be instable.

It is therefore an object of the present invention to provide a hypohalite bleach-containing composition, suitable for use in various laundry applications, which provides improved fabric whiteness to fabrics treated therewith and which has, at the same time, a commercially acceptable chemical stability along with an excellent overall stain removal performance on a wide range of stains.

The applicant has now found that the previous object can be met by formulating liquid composition comprising an alkali metal hypohalite, or mixtures thereof, and a soil suspending agent selected from the group consisting of an ethoxylated diamine, an ethoxylated polyamine, an ethoxylated amine polymer and mixture thereof, as described hereinafter.

Indeed, it has now been found that said composition allows to provide improved fabric whiteness on the fabrics treated therewith, as compared to the same composition without said soil suspending agent. Indeed, it has been found that the addition of a single compound, i.e., such a soil suspending agent, in a hypohalite bleach-containing composition, delivers improved bleaching performance and, in the same time, improved stain removal performance.

Another advantage of the compositions of the present invention is that they allow to provide outstanding fabric whitening action without compromising on the stain removal performance on different types of stains.

Moreover, the applicant has surprisingly found that the soil suspending agent, as defined herein, is chemically stable in hypochlorite-based compositions. Such a stability was unlikely to be obtained due to the chemical structure of the soil suspending agent herein. Indeed, the general thought was that such agents were prone to be decomposed and to be attacked by hypohalite bleach due to the presence of non-end protected ethoxy groups.

It has however been found that specific soil suspending agents are fully compatible with a hypohalite bleach medium, can easily be processed and have a reduced impact on the chemical stability properties of said compositions.

Indeed, the improved whitening action, and the improved stain removal performance on various stains, is maintained even for hypohalite bleaches compositions having undergone long storage periods. An advantage of the present invention is thus that chemically stable compositions are provided that are suitable to be used in the most efficient manner by the consumer over prolonged periods of time.

Another advantage of the compositions of the present invention is that said bleaching compositions are suitable for the bleaching of different types of fabrics including natural fabrics, (e.g., fabrics made of cotton, viscose, linen), synthetic fabrics such as those made of polymeric fibers of synthetic origin (e.g., polyamide-elasthane), as well as those made of both natural and synthetic fibers. Indeed, the compositions of the present invention may be used on synthetic fibers despite a standing prejudice against using hypochlorite bleaches on synthetic fibers, as evidenced by warnings on labels of commercially available hypochlorite bleaches and clothes.

Furthermore, it has been found that in a preferred embodiment of the present invention, the compositions herein may be formulated either as an emulsion or microemulsion, without the need for modifying the rheology of the compositions.

Compositions comprising soil suspending agent, as defined herein, i.e. ethoxylated diamines, ethoxylated polyamines and/or ethoxylated polymers, have been described in the art.

U.S. Pat. No. 4,659,802 discloses detergent compositions comprising ethoxylated diamines, ethoxylated polyamines and/or ethoxylated polymers as a clay soil removal antiredeposition agent. No hypohalite bleach compositions are disclosed.

EP A 111 965 discloses detergent compositions (pH=6 to 8.5) comprising ethoxylated mono- or diamines, ethoxylated polyamines and/or ethoxylated polymers as a clay soil removal/antiredeposition agent. No hypohalite bleach compositions are disclosed.

EP A 0839 903 discloses an acidic aqueous composition suitable for pretreating soiled fabrics comprising a peroxygen bleach and a soil suspending agent selected from the group consisting of an ethoxylated diamines, an ethoxylated polyamine, an ethoxylated amine polymer and mixtures thereof. No hypohalite bleach compositions are disclosed.

SUMMARY OF THE INVENTION

The present invention encompasses a liquid or solid bleaching composition, suitable for treating fabrics comprising a hypohalite bleach, and a soil suspending agent selected from the group consisting of:

1) ethoxylated diamines having the formula:

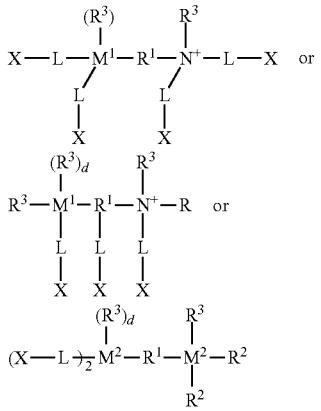

wherein $M^1$ is an $N^+$ or N group; each $M^2$ is an $N^+$ or N group, and at least one $M^2$ is an $N^+$ group;

2) ethoxylated polyamines having the formula:

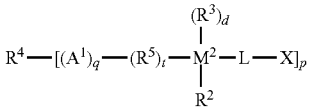

wherein each $M^2$ is an $N^+$ or N group;

3) ethoxylated polymers which comprises a polymer backbone, at least 2M groups and at least one L-X group, wherein M is a cationic group attached to or integral with the backbone; X is a selected from the group consisting of H, C1-C4 alkyl or hydroxyalkyl ester or ether groups or $SO_3^-$ group, and mixtures thereof; and L is a hydrophilic chain connecting groups M and X or connecting X to the polymer backbone, 4) mixtures thereof;

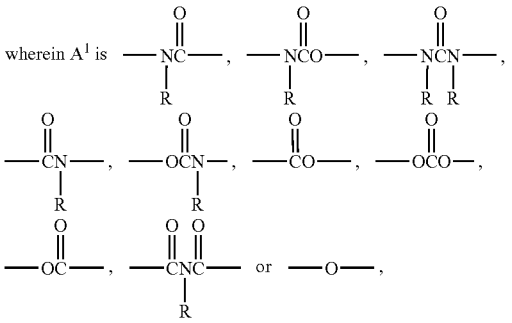

R is H or $C_1$-$C_4$ alkyl or hydroxyalkyl, $R^1$ is $C_2$-$C_{12}$ alkylene, hydroxyalkylene, alkenylene, arylene or alkarylene, or a $C_2$-$C_3$ oxyalkylene moiety having from 2 to 20 oxyalkylene units provided that no O—N bonds are formed; each $R^2$ is $C_1$-$C_4$ alkyl or hydroxyalkyl, the moiety -L-X, or two $R^2$ together form the moiety —$(CH_2)_r$-$A^2$-$(CH_2)_s$—, wherein $A^2$ is —O— or —$CH_2$—, r is 1 or 2, s is 1 or 2 and r+s is 3 or 4; each $R^3$ is $C_1$-$C_8$ alkyl or hydroxyalkyl, benzyl, the moiety L-X, or two $R^3$ or one $R^2$ and one $R^3$ together form the moiety —$(CH_2)_r$-A2-$(CH_2)_s$—; $R^4$ is a substituted $C_3$-$C_{12}$ alkyl, hydroxyalkyl, alkenyl, aryl or alkaryl group having p substitution sites; $R^5$ is $C_1$-$C_{12}$ alkenyl, hydroxyalkylene, alkenylene, arylene or alkarylene, or a $C_2$-$C_3$ oxyalkylene moiety having from 2 to 20 oxyalkylene units provided that no O—O or O—N bonds are formed; X is selected from the group consisting of H, $C_1$-$C_4$ alkyl or hydroxyalkyl ester or ether groups or $SO_3^-$ group, and mixtures thereof; L is a hydrophilic chain which contains the polyoxyalkylene moiety —$[(R^6O)_m(CH_2CH_2O)_n]$—; wherein $R^6$ is $C_3$-$C_4$ alkylene or hydroxyalkylene and m and n are numbers such that the moiety —$(CH_2CH_2O)_n$— comprises at least 50% by weight of said polyoxyalkylene moiety; d is 1 when $M^2$ is N+ and is 0 when $M^2$ is N; n is at least 6 for said diamines and is at least 3 for said polyamines and polymers; p is from 3 to 8; q is 1 or 0; t is 1 or 0, provided that t is 1 when q is 1.

The present invention also encompasses a process of bleaching fabrics, wherein said fabrics are contacted with a bleaching composition as defined herein, in its neat or diluted form. The present invention further encompasses the use of a soil suspending agent as defined herein, in a bleaching composition comprising a hypohalite, to improve the fabric whiteness performance of said composition.

DETAILED DESCRIPTION OF THE INVENTION

The present invention encompasses a composition suitable for treating fabrics, comprising a hypohalite bleach, and a soil suspending agent selected from the group consisting of an ethoxylated diamine, an ethoxylated polyamine, an ethoxylated amine polymer and mixture thereof, as defined before. Preferably the soil suspending agent is an ethoxylated diamine.

In a preferred embodiment, the soil suspending agent is an ethoxylated cationic diamine, more preferably the soil suspending agent is a 24-Ethoxylated Hexamethylene Diamine Quaternized. In a even more preferred embodiment, the soil suspending agent is a sulphated ethoxylated zwiterrionic diamine; more preferably, the soil suspending agent is a trans-sulphated 24-Ethoxylated Hexamethylene Diamine Quaternized.

The addition of such a soil suspending agent in a composition comprising a hypohalite bleach, provides improved stain removal performance on various stains as well as improved whiteness performance while maintaining adequate chemical stability. By "stain removal performance" it is meant herein stain removal performance on a variety of stains/soils such as greasy/oily stains, and/or enzymatic stains and/or mud/clay stains (particulate stains). By "greasy/oily stains" it is meant herein any soil and stain of greasy nature that can be found on a fabric like dirty motor oil, mineral oil, make-up, vegetal oil, spaghetti sauce, mayonnaise and the like. Examples of enzymatic stains include grass, chocolate and blood.

The soil suspending agents herein are fully compatible with hypohalite bleaches. Without wishing to be bound by theory, the bleach-compatibility of the soil suspending agents herein can be explained as follows. The quaternization of the nitrogen groups of these molecules is believed to have a dual purpose. It provides a cationic charge on the molecule, improving adsorption onto stains/particles like clay on the fabric surface, and it removes the oxidisable lone pair on the nitrogen groups from attack by bleaching species, thus making the molecule stable in an aqueous hypohalite bleach containing composition. Moreover, when the soil suspending agents are in the form of an ethoxylated diamine, they are even more stable in an aqueous hypohalite bleach containing composition and fully compatible with an alkaline medium. Such stability is unexpected due to the general thought that the presence of the non-end protected ethoxy group (i.e. —$CH_2CH_2OH$), contained in such compound, would be easily attacked and damaged by hypohalite ions. Indeed, the aqueous bleaching compositions of the present invention are chemically and physically stable. By "chemically stable" it is meant herein that the attack and/or oxidation by said hypohalite bleach on the soil suspending agent, contained in the composition, is reduced, even absent. In other words, the concentration of the soil suspending agent is substantially stable, i.e., do not undergo more than 25% loss of the agent after 5 days of storage at 50° C.±0.5° C., which is a sufficient chemical stability for a commercial product. By "physically stable" it is meant herein that the compositions of the present invention do not split in two or more phases when exposed in stressed conditions, e.g., at a temperature of 50° C. during 5 days.

The compositions according to the present invention may be formulated in a solid form or in a liquid form including gel and paste form. Preferably the compositions are formulated in a liquid form. Preferred liquid bleaching compositions of the present invention are aqueous and therefore, preferably comprise water. More preferably the compositions according to the present invention comprise water in an amount of from 50% to 99%, even more preferably of from 60% to 97% and most preferably 80% to 95% by weight of the total composition.

Hypohalite Bleaches

As a first essential ingredient, the compositions of the present invention comprise a hypohalite bleach. Any hypohalite bleach known to those skilled in the art may be suitable for use herein.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For the bleaching compositions herein, the preferred hypohalite bleaches among those described above are the alkali metal or alkaline earth metal hypochlorites selected from the group consisting of sodium, potassium, magnesium, lithium and calcium hypochlorites, and mixtures thereof. Sodium hypochlorite is the most preferred hypohalite bleach.

Preferably the composition according to the invention contains as hypohalite bleach, for liquid bleaching compositions, an alkali metal sodium hypochlorite and, for solid compositions, sodium dichloroisocyanurate and/or calcium hypochlorite.

Preferably, the bleaching compositions according to the present invention may comprise said hypohalite bleach such that the content of active halide in the composition is from 0.01% to 20% by weight, preferably from 0.1% to 10%, even more preferably 0.5% to 6% by weight of the liquid composition or in an amount of from 10% to 80% by weight, preferably from 30% to 60% by weight of the solid composition.

pH

The pH of the liquid compositions according to the present invention is above 8; typically from 8 to 14, preferably from 8.5 to 14, more preferably from 9 to 13.5, and even more preferably from 9.5 to 13.5, measured at 25° C. The pH of solid compositions according to the present invention, is typically from 5 to 13, preferably from 6 to 11 after the composition has been diluted into 1 to 500 times its weight of water.

During the bleaching process, e.g., at a dilution level of 200:1 (water:composition), the liquid compositions of the invention may have a pH of at least 8, preferably at least 8.5, more preferably at least 9.5 for a longer period of time. It is in this alkaline range that the optimum stability and performance of the hypohalite bleach are obtained. The pH range is suitably provided by a pH buffering component if present and the hypohalite bleach mentioned hereinbefore, which are alkalis. However, in addition to these components, an alkalinity source may also optionally be used.

Suitable alkalinity sources for use herein are the caustic alkalis, such as sodium hydroxide, potassium hydroxide and/or lithium hydroxide, and/or the alkali metal oxides such, as sodium and/or potassium oxide or mixtures thereof. A preferred alkalinity source is a caustic alkali, more preferably sodium hydroxide and/or potassium hydroxide.

Preferred bleaching compositions herein may comprise up to 10%, preferably from 0.04% to 5% and more preferably from 0.1% to 2% by weight of the total composition of said alkalinity source.

Soil Suspending Agent

As an essential element the compositions according to the present invention comprise a soil suspending agent selected from the group consisting of ethoxylated diamines, ethoxylated polyamines, ethoxylated amine polymers, as previously defined and mixtures thereof. Preferably the soil suspending agent is an ethoxylated diamine.

In a preferred embodiment, the soil suspending agent is an ethoxylated cationic diamine, more preferably the soil suspending agent is a 24-Ethoxylated Hexamethylene Diamine Quaternized. In a even more preferred embodiment, the soil suspending agent is a sulphated ethoxylated zwiterrionic diamine; more preferably, the soil suspending agent is a transsulphated 24-Ethoxylated Hexamethylene Diamine Quaternized.

The compositions according to the present invention comprise from 0.01% to 10% by weight of the total composition of such a soil suspending agent or mixtures thereof, preferably from 0.05% to 5%, more preferably 0.05% to 2% and most preferably from 0.1% to 0.5%.

In the preceding formulas for the amines, R1 can be branched

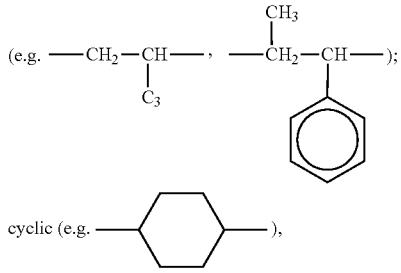

or must preferably linear (e.g. —$CH_2CH_2$—,—$CH_2CH_2$—$CH_2$—)

alkylene, hydroxyalkylene, alkenylene, alkarylene or oxyalkylene. $R^1$ is preferably $C_2$-$C_6$ alkylene for the ethoxylated diamines. Each $R^2$ is preferably methyl or the moiety -L-X; each $R^3$ is preferably $C_1$-$C_4$ alkyl or hydroxyalkyl, and most preferably methyl.

The positive charge of the $N^+$ groups is offset by the appropriate number of counter anions. Suitable counter anions include $Cl^-$, $Br^-$, $SO_3^{2-}$, $PO_4^{2-}$, $MeOSO_3^-$ and the like. Particularly preferred counter anions are $Cl^-$ and $Br^-$.

X can be selected from hydrogen (H), $C_1$-$C_4$ alkyl or hydroxyalkyl ester or ether groups, $SO_3^-$ or mixtures thereof. Preferred esters or ethers are the acetate ester and methyl ether, respectively. The particularly preferred nonionic groups are H and the methyl ether. The particularly preferred group is $SO_3^-$.

In the preceding formulas, hydrophilic chain L usually consists entirely of the polyoxyalkylene moiety —[$(R^6O)_m$ ($CH_2CH_2$—$O_n$)—]. The moieties —$(R^6O)_m$— and —$(CH_2CH_2O)_n$— of the polyoxyalkylene moiety can be mixed together or preferably form blocks of —$(R_6O)_m$— and —$(CH_2CH_2O)_n$— moieties. $R^6$ is preferably $C_3H_6$ (propylene); m is preferably from 0 to 5 and is most preferably 0, i.e. the polyoxyalkylene moiety consists entirely of the moiety —$(CH_2CH_2O)_n$—. The moiety —$(CH_2CH_2O)_n$— preferably comprises at least 85% by weight of the polyoxyalkylene moiety and most preferably 100% by weight (m is O).

In the preceding formulas, $M^1$ and each $M^2$ are preferably an $N^+$ group for the cationic diamines and polyamines.

Preferred ethoxylated cationic diamines have the formula:

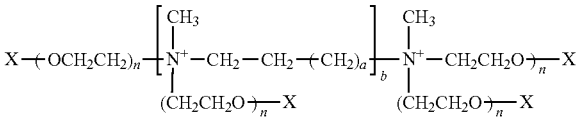

wherein X and n are defined as before, a is from 0 to 4 (e.g. ethylene, propylene, hexamethylene) b is 1. For preferred cationic diamines, n is at least 12 with a typical range of from 12 to 42.

More preferably, preferred ethoxylated diamines polymer are zwiterrionic polymer and, preferably, have the above formula with at least one of the X is $SO_3^-$.

In the preceding formula for the ethoxylated polyamines, R4 (linear, branched, or cyclic) is preferably a substituted $C_3$-$C_6$ alkyl, hydroxyalkyl or aryl group; $A^1$ is preferably

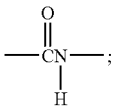

n is preferably at least 12, with a typical range of from 12 to 42; p is preferably from 3 to 6. When $R^4$ is a substituted aryl or alkaryl group, q is preferably 1 and $R^5$ is preferably $C_2$-$C_3$ alkylene. When $R^4$ is a substituted alkyl, hydroxyalkyl, or alkenyl group, and when q is 0, $R^5$ is preferably a $C_2$-$C_3$ oxyalkylene moiety; when q is 1, $R^5$ is preferably $C_2$-$C_3$ alkylene.

These ethoxylated polyamines can be derived from polyamino amides such as:

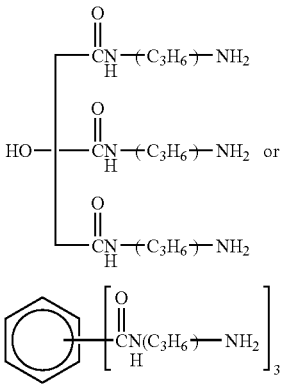

These ethoxylated polyamines can also be derived from polyaminopropyleneoxide derivatives such as:

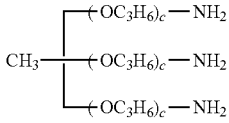

wherein each c is a number from 2 to 20.

The water soluble polymers of the present invention comprises a polymer backbone, at least 2M groups and at least one L-X group, wherein M is a cationic group attached to or integral with the backbone; X is a group selected from the group consisting of H, $C_1$-$C_4$ alkyl or hydroxyalkyl ester or ether groups, $SO_3^-$and mixtures thereof; and L is a hydrophilic chain connecting groups M and X or connecting X to the polymer backbone.

As used herein, the term "polymer backbone" refers to the polymeric moiety to which groups M and L-X are attached or are integral with. Included within this term are oligomer backbones (2 to 4 units), and true polymer backbones (5 or more units).

As used herein, the term "attached to" means that the group is pendent from the polymer backbone, examples of such attachment being represented by the following general structures A and B:

A

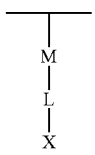

B

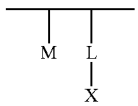

As used herein, the term "integral with" means that the group forms part of the polymer backbone, examples of which are represented by the following general structures C and D:

C

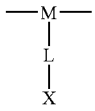

D

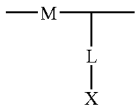

Any polymer backbone can be used as long as the polymer formed is water-soluble and has soil removal/anti-redeposition properties. Suitable polymer backbones can be derived from the polyurethanes, the polyesters, the polyethers, the polyamides, the polyimides and the like, the polyacrylates, the polyacrylamides, the polyvinylethers, the polyethylenes, the polypropylenes and like polyalkylenes, the polystyrenes and like polyalkarylenes, the polyalkyleneamines, the polyalkyleneimines, the polyvinylamines, the polyalylamines, the polydiallylamines, the polyvinylpyridines, the polyaminotriazoles, polyvinyl alcohol, the arninopolyureylenes, and mixtures thereof.

M can be any compatible cationic group which comprises an $N^+$ (quarternary), positively charged center. The quarternary positively charged center can be represented by the following general structures E and F:

E

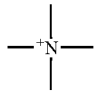

F

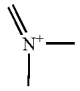

Particularly preferred M groups are those containing a quarternary center represented by general structure E. The cationic group is preferably positioned close to or integral with the polymer backbone.

The positive charge of the $N^+$ centres is offset by the appropriate number of counter anions. Suitable counter anions include $Cl^-$, $Br^-$, $SO_3^{2-}$, $SO_4^{2-}$, $PO_4^{2-}$, $MeOSO_3^-$ and the like. Particularly preferred counter anions are $Cl^-$ and $Br^-$.

X can be a group selected from hydrogen (H), $C_1$-$C_4$ alkyl or hydroxyalkyl ester or ether groups, and mixtures thereof. X can also be $SO_3^-$. The preferred ester or ether groups are the acetate ester and methyl ether, respectively. The particularly preferred groups are H and the methyl ether and $SO_3^-$.

The polymers suitable for use in compositions in accord with the present inventions normally have a ratio of cationic groups M to nonionic groups X of from 1:1 to 1:2. However, for example, by appropriate copolymerization of cationic, nonionic (i.e. containing the group L-X), and mixed cationic/nonionic monomers, the ratio of cationic groups M to nonionic groups X can be varied. The ratio of groups M to groups X can usually range from 2:1 to 1:10. In preferred cationic polymers, the ratio is from 1:1 to 1:5. The polymers formed from such copolymerization are typically random, i.e. the cationic, nonionic and mixed cationc/nonionic monomers copolymerize in a nonrepeating sequence.

The units which contain groups M and groups L-X can comprise 100% of the polymers of the present invention. However, inclusion of other units (preferably nonionic) in the polymers is also permissible.

Examples of other units include acrylamides, vinyl ethers and those containing unquaternized tertiary amine groups (M1) containing an N centre. These other units can comprise from 0% to 90% of the polymer (from 10% to 100% of the polymer being units containing M and L-X groups, including M1-L-X groups). Normally, these other units comprise from 0% to 50% of the polymer (from 50% to 100% of the polymer being units containing M and L-X groups).

The number of groups M and L-X each usually ranges from 2 to 200. Typically the number of groups M and L-X are each from 3 to 100. Preferably, the number of groups M and L-X are each from 3 to 40.

Other than moieties for connecting groups M and X, or for attachment to the polymer backbone, hydrophilic chain L usually consists entirely of the polyoxyalkylene moiety —$[(R'O)_m(CH_2CH_2O)_n]$—. The moieties —$(R'O)_m$— and —$(CH_2CH_2O)_n$— of the polyoxyalkylene moiety can be mixed together, or preferably form blocks of —$(R'O)_m$— and —$(CH_2CH_2O)_n$— moieties. R' is preferably $C_3H_6$ (propylene); m is preferably from 0 to 5, and most preferably 0; i.e. the polyoxyalkylene moiety consists entirely of the moiety —$(CH_2CH_2O)_n$—. The moiety —$(CH_2CH_2O)_n$— preferably comprises at least 85% by weight of the polyoxyalkylene moiety, and most preferably 100% by weight (m is 0). For the moiety —$(CH_2CH_2O)_n$—, n is usually from 3 to 100. Preferably, n is from 12 to 42.

A plurality (2 or more) of moieties -L-X can also be hooked together and attached to group M or to the polymer backbone, examples of which are represented by the following general structures G and H:

G

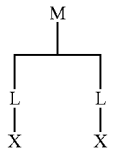

H

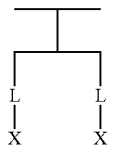

Structures such as G and H can be formed, for example, by reacting glycidol with group M or with the polymer backbone, and ethoxylating the subsequently formed hydroxy groups.

Representative classes of polymers of the present invention are as follows:

A. Polyurethane, Polyester, Polyether, Polyamide or like Polymers.

One class of suitable polymers are derived from polyurethanes, polyesters, polyethers, polyamides and the like. These polymers comprise units selected from those having formulas I, II and III:

I

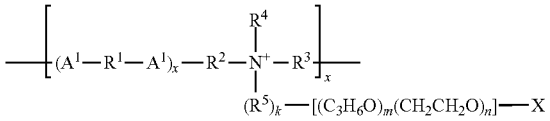

II

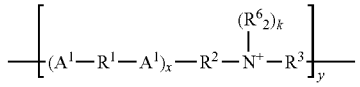

III

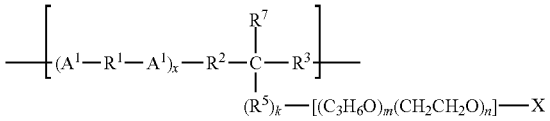

wherein $A^1$ is

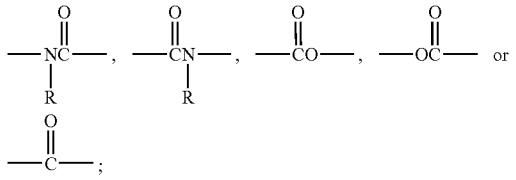

x is 0 or 1; R is H or $C_1$-$C_4$ alkyl or hydroxyalkyl; $R^1$ is $C_2$-$C_{12}$ alkylene, hydroxyalkylene, alkenylene, cycloalkylene, arylene or alkarylene, or a $C_2$-$C_3$ oxyalkylene moiety having from 2 to abut 20 oxyalkylene units provided that no O—O or O—N bonds are formed with $A^1$; when x is 1, $R^2$ is —$R^5$— except when $A^1$ is

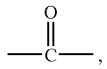

or is —$(OR^8)_y$— or —$OR^5$— provided that no O—O or N—O bonds are formed with $A^1$, and $R^3$ is —$R^5$— except when $A^1$ is

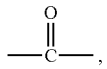

or is —$(R^8O)$-y or —$R^5O$— provided that no O—O or O—N bonds are formed with $A^1$; when x is 0, $R^2$ is

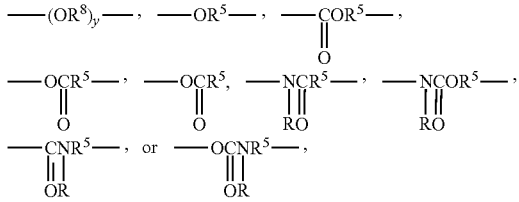

and $R^3$ is —$R^5$—; $R^4$ is $C_1$-$C_4$ alkyl or hydroxyalkyl, or the moiety —$(R^5)_k$—$[(C_3H_6O)_m(CH_2CH_2O)_n]$—X; $R^5$ is $C_1$-$C_{12}$ alkylene, hydroxyalkylene, alkenylene, arylene, or alkarylene; each $R^6$ is $C_1$-$C_4$ alkyl or hydroxyalkyl, or the moiety —$(CH_2)_r$-$A^2$-$(CH_2)$s-, wherein $A^2$ is —O— or —$CH_2$—; $R^7$ is H or $R^4$; $R^8$ is $C_2$-$C_3$ alkylene or hydroxyalkylene; X is H or $SO_3^-$,

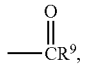

—$R^9$ or a mixture thereof, wherein $R^9$ is $C_1$-$C_4$ alkyl or hydoxyalkyl; k is 0 or 1; m and n are numbers such that the moiety —$(CH_2CH_2O)_n$— comprises at least 85% by weight of the moiety —$[(C_3H_6O)_m(CH_2CH_2O)_n]$—; m is from 0 to 5; n is at least 3; r is 1 or 2, s is 1 or 2, and r+s is 3 or 4; y is from 2 to 20; the number of u, v and w are such that there are at least 2 $N^+$ centers and at least 2 X groups.

In the above formulas, $A^1$ is preferably

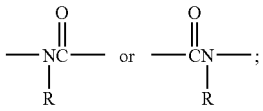

$A^2$ is preferably —O—; x is preferably 1; and R is preferably H. $R^1$ can be linear (e.g. —$CH_2$—$CH_2$—$CH_2$—,

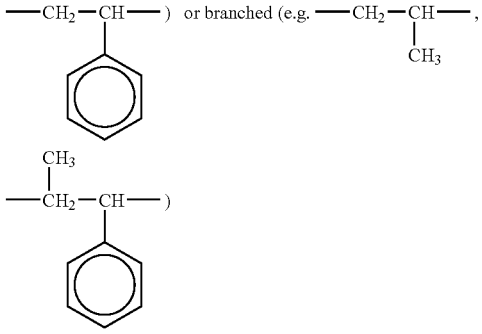

alkylene, hydroxyalkylene, alkenylene, cycloalkylene, alkarylene or oxyalkylene; when $R^1$ is a $C_2$-$C_3$ oxyalkylene moiety, the number of oxyalkylene units is preferably from 2 to 12; $R^1$ is preferably $C_2$-$C_6$ alkylene or phenylene, and most preferably $C_2$-$C_6$ alkylene (e.g. ethylene, propylene, hexamethylene). $R^2$ is preferably —$OR^5$— or —$(OR^8)_y$—; R3 is preferably —$R^5O$— or —$(OR^8)_y$—; $R^4$ and $R^6$ are preferably methyl. Like $R^1$, $R^5$ can be linear or branched, and is preferably $C_2$-$C_3$ alkylene; $R^7$ is preferably H or $C_1$-$C_3$ alkyl; $R^8$ is preferably ethylene; $R^9$ is preferably methyl; X is preferably H or methyl or $SO_3^-$; k is preferably 0; m is preferably 0, r and s are each preferably 2; y is preferably from 2 to 12.

In the above formulas, n is preferably at least 6 when the number of $N^+$ centers and X groups is 2 or 3; n is most preferably at least 12, with a typical range of 12 to 42 for all ranges of u+v+w. For homopolymers (v and w are 0), u is preferably from 3 to 20. For random copolymers (u is at least 1 or preferably 0), v and w are each preferably from 3 to 40.

B. Polyacrylate, Polyacrylamide, Polyvinylether or like Polymers

Another class of suitable polymers are derived from polyacrylates, polyacrylamides, polyvinylethers and the like. These polymers comprise units selected from those having formulas IV, V and VI.

IV

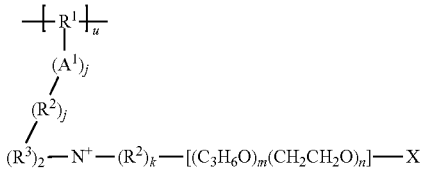

V

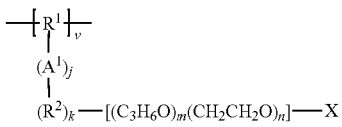

-continued

VI

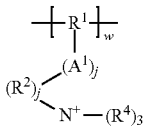

wherein $A^1$ is —O—, —NC(=O)(R)—, —NCO(=O)(R)—,

—CNC(=O)(=O)(R)—, —CN(=O)(R)—, —OCN(=O)(R)—, —OC(=O)—,

—OCO(=O)—, —CO(=O)—, or —NCN(=O)(=O)(R)(R);

R is H or $C_1$-$C_4$ alkyl or hydroxyalkyl; $R^1$ is substituted $C_2$-$C_{12}$ alkylene, hydroxyalkylene, alkenylene, arylene or alkarylene, or $C_2$-$C_3$ oxyalkylene; each $R^2$ is $C_1$-$C_{12}$ alkylene, hydroxyalkylene, alkenylene, arylene or alkarylene; each $R^3$ is $C_1$-$C_4$ alkyl or hydroxyalkyl, the moiety —$(R^2)$k-$[(C_3H_6O)_m(CH_2CH_2O)_n]$—X, or together form the moiety —$(CH_2)_r$-$A^2$-$(CH_2)_s$—, wherein $A^2$ is —O— or —$CH_2$—; each $R^4$ is $C_1$-$C_4$ alkyl or hydroxyalkyl, or two $R^4$ together form the moiety —$(CH_2)_r$-$A^2$-$(CH_2)_s$—; X is H or $SO_3^-$,

—C(=O)$R^5$,

—$R^5$ or mixture thereof, wherein $R^5$ is $C_1$-$C_4$ alkyl or hydroxyalkyl; j is 1 or 0; k is 1 or 0; m and n are numbers such that the moiety —$(CH_2CH_2O)_n$— comprises at least 85% by weight of the moiety —$[(C_3H_6O)_m(CH_2CH_2O)_n]$—; m is from 0 to 5; n is at least 3; r is 1 or 2, s is 1 or 2 and r+s is 3 or 4; the number of u, v and w are such that there are at least 2N+ centres and at least 2 X groups.

In the above formulas, $A^1$ is preferably

—CN(=O)(R)—, —CO(=O)— or —O—;

$A^2$ is preferably —O—; R is preferably H. $R^1$ can be linear (e.g. —$CH_2$—$CH_2$—$CH_2$—, —$CH_2CH$(—$C_6H_5$)—) or -continued branched (e.g. —$CH_2$—C($CH_3$)—, —$CH_2CH$($CH_3$)—,

—$CH_2$C($CH_3$)($C_6H_5$)—, —$CH_2$C($C_6H_5$)($CH_2$)—)

substituted alkylene, hydroxyalkylene, alkenylene, alkarylene or oxyalkylene; $R^1$ is preferably substituted $C_2$-$C_6$ alkylene or substituted $C_2$-$C_3$ oxyalkylene, and most preferably —$CH_2CH$(—)— or —$CH_2$—C($CH_3$)(—)—.

Each $R^2$ is preferably $C_2$-$C_3$ alkylene, each $R^3$ and $R^4$ are preferably methyl; $R^5$ is preferably methyl; X is preferably H or methyl or $SO_3^-$; j is preferably 1; k is preferably 0; m is preferably 0; r and s are each preferably 2.

In the above formulas, n, u, v and w can be varied according to the n, u, v and w for the polyurethane and like polymers.

C. Polyalkyleneamine, Polyalkyleneimine or like polymers.

Another class of suitable polymers are derived from polyalkyleneamines, polyalkyleneimines and the like. These polymers comprise units selected from those having formulas VII and VIII and I.

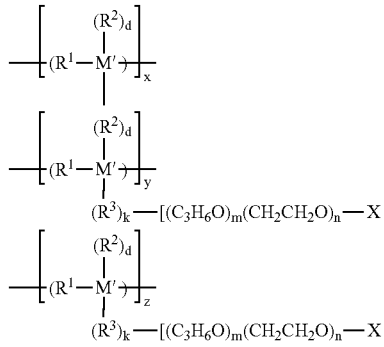

wherein $R^1$ is $C_2$-$C_{12}$ alkylene, hydroxyalkylene, alkenylene, cycloalkylene, arylene or alkarylene, or a $C_2$-$C_3$ oxyalkylene moiety having from 2 to 20 oxyalkylene units provided that no O—N bonds are formed; each $R^2$ is $C_1$-$C_4$ alkyl or hydroxyalkyl, or the moiety —$(R^3)_k$—$[(C_3H_6O)_m(CH_2CH_2O)_n]$—X; $R^3$ is $C_1$-$C_{12}$ alkylene, hydroxyalkylene, alkenylene, arylene or alkarylene; M' an N+ or N centre; X is H or $SO_3^-$,

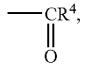

$R^4$ or mixture thereof, wherein $R^4$ is $C_1$-$C_4$ alkyl or hydroxyalkyl; d is 1 when M' is N+ and is 0 when M' is N; e is 2 when M' is N+ and is 1 when M' is N; k is 1 or 0; m and n are numbers such that the moiety —$(CH_2CH_2O)_n$— comprises at least 85% by weight of the moiety —$[(C_3H_6O)_m(CH_2CH_2O)_n]$—; m is from 0 to 5; n is at least 3; the number of x, y and z are such that there are at least 2M' groups, at least 2N+ centres and at least 2 X groups.

In the above formulas, $R^1$ can be varied like $R^1$ of the polyurethene and like polymers; each $R^2$ is preferably methyl or the moiety —$(R^3)_k$—$[(C_3H_6O)_m(CH_2CH_2O)_n]$—X; $R^3$ is preferably $C_2$-$C_3$ alkylene; $R^4$ is preferably methyl; X is preferably H or $SO_3^-$; k is preferably 0; m is preferably 0.

In the above formulas, n is preferably at least 6 when the number of M' and X groups is 2 or 3; n is most preferably at least 12, with a typical range of from 12 to 42 for all ranges of x+y+z. Typically, x+y+z is from 2 to 40 and preferably from 2 to 20. For short chain length polymers, x+y+z can range from 2 to 9 with from 2 to 9 N+ centres and from 2 to 11 X groups. For long chain length polymers, x+y+z is at least 10, with a preferred range of from 10 to 42. For the short and long chain length polymers, the M' groups are typically a mixture of from 50 to 100% N+ centres and from 0 to 50% N centres.

Preferred polymers within this class are derived from the $C_2$-$C_3$ polyalkyleneamines (x+y+z is from 2 to 9) and polyalkyleneimines (x+y+z is at least 10, preferably from 10 to 42). Particularly preferred polyalkyleneamines and polyalkyleneimines are the polyethyleneamines (PEA's) and polyethyleneimines (PEI's). These preferred polymers comprise units having the general formula:

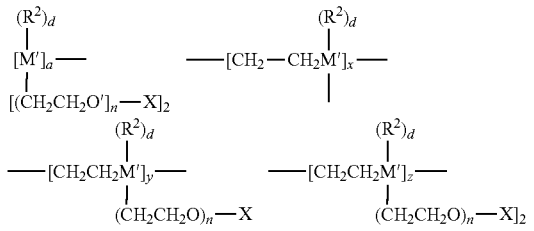

wherein $R^2$ (preferably methyl), M', X, d, x, y, z and n are defined as before; a is 1 or 0.

Prior to ethoxylation, the PEAs used in preparing polymers of the present invention have the following general formula:

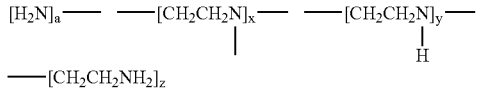

wherein x+y+z is from 2 to 9, and a is 0 or 1 (molecular weight of from 100 to 400). Each hydrogen atom attached to each nitrogen atom represents an active site for subsequent ethoxylation. For preferred PEAs, x+y+z is from 3 to 7 (molecular weight is from 140 to 310). These PEA's can be obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372 to Dickson, issues May 14, 1957, which describes the preparation of PEAs.

The minimum degree of ethoxylation required for preferred soil removal/anti-redeposition performance can vary depending upon the number of units in the PEA. Where y+z is 2 or 3, n is preferably at least 6. Where y+z is from 4 to 9, suitable benefits are achieved when n is at least 3. For preferred PEAs, n is at least 12, with a typical range of 12 to 42.

The PEIs used in preparing the polymers of the present invention have a molecular weight of at least 440 prior to ethoxylation, which represents at least 10 units. Preferred PEIs used in preparing these polymers have a molecular weight of from 600 to 1800. The polymer backbone of these PEIs can be represented by the general formula:

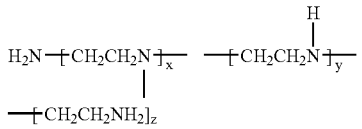

wherein the sum of x, y, and z represents a number of sufficient magnitude to yield a polymer having the molecular weights previously specified. Although linear polymer backbones are possible, branch chains can also occur. The relative proportions of primary, secondary and tertiary amine groups present in the polymer can vary, depending on the manner of preparation. The distribution of amine groups is typically as follows:

| | |
|---|---|
| —$CH_2CH_2$—$NH_2$ | 30% |
| —$CH_2CH_2$—NH— | 40% |
| —$CH_2CH_2$—N(H)— | 30% |

Each hydrogen atom attached to each nitrogen atom of the PEI represents an active site for subsequent ethoxylation. These PEIs can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEIs are disclosed in U.S. Pat. No. 2,182,306 to Ulrich et al., issued Dec. 5, 1939; U.S. Pat. No. 3,033,746 to Mayle et al., issued May 8, 1962; U.S. Pat. No. 2,208,095 to Esselmann et al., issued Jul. 16, 1940; U.S. Pat. No. 2,806,839 to Crowther, issued Sep. 17, 1957; and U.S. Pat. No. 2,533,696 to Wilson, issued May 21, 1951.

As defined in the preceding formulas, n is at least 3 for the cationic PEIs. However, it should be noted that the minimum degree of ethoxylation required for suitable soil removal/anti-redeposition performance can increase as the molecular weight of the PEI increases, especially much beyond 1800.

Also, the degree of ethoxyalation for preferred polymers increases as the molecular weight of the PEI increases. For PEIs having a molecular weight of at least 600, n is preferably at least 12, with a typical range of from 12 to 42. For PEIs having a molecular weight of at least 1800, n is preferably at least 24, with a typical range of from 24 to 42.

D. Diallylamine Polymers

Another class of suitable polymers are those derived from the diallylamines. These polymers comprise units selected from those having formulas X and XI:

wherein $R^1$ is $C_1$-$C_4$ alkyl or hydroxyalkyl, or the moiety $—(R^2)_k—[(C_3H_6O)_m(CH_2CH_2O)_n]—X$; $R^2$ is $C_1$-$C_{12}$ alkylene, hydroxyalkylene, alkylene, arylene or alkarylene; each $R^3$ is $C_1$-$C_4$ alkyl or hydroxyalkyl, or together form the moiety $—(CH_2)_r$-A-$(CH_2)s$-, wherein A is —O— or $—CH_2—$; X is H or $SO_3^-$, $$—\underset{\underset{O}{\|}}{C}R^4,$$

$—R^4$ or mixture thereof, wherein $R^4$ is $C_1$-$C_4$ alkyl or hydroxyalkyl; k is 1 or 0; m and n are numbers such that the moiety $—(CH_2CH_2O)_n—$ comprises at least 85% by weight of the moiety $—[(C_3H_6O)_m(CH_2CH_2O)_n]—$; m is from 0 to 5; n is at least 3; r is 1 or 2, s is 1 or 2, and r+s is 3 or 4; x is 1 or 0; y is 1 when x is 0 and 0 when x is 1; the number of u and v are such that there are at least 2N+ centres and at least 2 X groups.

In the above formulas, A is preferably —O—; $R^1$ is preferably methyl; each $R^2$ is preferably $C_2$-$C_3$ alkylene; each $R^3$ is preferably methyl; $R^4$ is preferably methyl; X is preferably H or $SO_3^-$; k is preferably 0; m is preferably 0; r and s are each preferably 2.

In the above formulas, n is preferably at least 6 when the number of N+ centres and X groups are each 2 or 3, n is preferably at least 12, with a typical range of from 12 to 42 for all range of u+v. Typically, v is 0, and u is from 2 to 40, and preferably from 2 to 20.

Optional Ingredients

The bleaching compositions according to the present invention may further comprise optional ingredients, such as pH buffering components, surfactants, polymers, pigments, optical brighteners, solvents, stabilizing agents, hydrotropes, perfumes, latex and the like. The bleaching compositions according to the present invention may optionally comprise a pH buffering component. Particularly useful are alkali metal salts of carbonates, polycarbonates, sesquicarbonates, silicates, polysilicates, phosphonates, stannates, alluminates or mixtures thereof. The preferred alkali metal salts to be used herein are sodium and potassium salts. Particularly preferred are alkali metal salts of carbonate. The preferred alkali metal salt of carbonate is sodium carbonate.

The pH buffering components provide a prolonged through-the-bleach buffering action, i.e., maintain the pH of the bleaching solution at a pH of at least 8, preferably at least 8.5, more preferably at least 9.5 for a longer period of time, throughout the bleaching process, e.g., at a dilution level of 200:1 (water:composition), as compared to the buffering action obtained with the same composition without said pH buffering components.

The bleaching compositions of the present invention may comprise up to 10%, preferably from 0.01% to 5% and more preferably from 0.02% to 3% by weight of the total composition of a pH buffering component.

Accordingly, the compositions of the present invention preferably comprise a surfactant or mixtures thereof. Any surfactant known to those skilled in the art may be suitable herein including nonionic, anionic, cationic, zwitterionic, and/or amphoteric surfactants up to 50% by weight of the total composition. Surfactants allow to further improve the stain removal properties of the compositions according to the present invention. Nonionic surfactants are highly preferred herein for performance reasons. The liquid compositions herein may comprise up to 50% of a nonionic surfactant or mixtures thereof, preferably from 0.3% to 30% and more preferably from 0.4% to 25%. Suitable nonionic surfactants to be used are described in EP 0 839 903 B1 (page 19 line 28 to page 21 line 48).

The compositions may comprise a chelating agent as a preferred optional ingredient. Suitable chelating agents to be used herein include chelating agents selected from the group of phosphonate chelating agents, amino carboxylate chelating agents, polyfunctionally-substituted aromatic chelating agents, and further chelating agents like glycine, salicylic acid, aspartic acid, glutamic acid, malonic acid, or mixtures thereof. Chelating agents when used, are typically present herein in amounts ranging from 0.001% to 5% by weight of the total composition and preferably from 0.05% to 2% by weight. Suitable chelating agents to be used are described in EP 0 839 903 B1 (page 22, line 58 to page 23, line 47).

The compositions may comprise radical scavengers as a preferred optional ingredient. Suitable radical scavengers for use are described in EP 0 839 903 B1 (page 22, lines 48 to 55).

Process of Treating Fabrics

The present invention also encompasses a process of treating a fabric. In such a process a composition according to the present invention is contacted with the fabrics to be treated. By "fabrics", it is to be understood any types of fabrics including for example clothes, curtains, drapes, bed linens, bath linens, table cloths, sleeping bags, tents, upholstered furniture and the like. The process of bleaching fabrics herein is suitable for both natural fabrics and synthetic fabrics. By "natural" fabrics, it is meant fabrics made of cotton, viscose or linen. By "synthetic" fabrics, it is meant those made of synthetic fibers like polymeric fibers (polyamide, polyester, Lycra® and Elasthane®), and those made of both natural and synthetic fibers.

This can be done either in a so-called "pretreatment mode", where a liquid bleaching composition, as defined herein, is applied neat onto said fabrics before the fabrics are rinsed, or washed then rinsed, or in a "soaking mode" where a liquid bleaching composition, as defined herein, is first diluted in an aqueous bath and the fabrics are immersed and soaked in the bath, before they are rinsed, or in a "through the wash mode", where a liquid bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The composition can be in a solid or in a liquid form. The compositions according to the present invention are preferably contacted to fabrics in a liquid form. By "in a liquid form", it is meant herein the liquid compositions according to the present invention is used per se in its neat or diluted form, or, when the composition is on a solid form, it is used in its dissolved or dispersed form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

By "in its neat form", it is to be understood that the compositions described herein are applied onto the fabrics to be treated without undergoing any dilution prior the application by the user.

By "in its dissolved or dispersed form", it is to be understood that the solid composition has to be dissolved or dispersed by the user before its use, in a liquid, preferably into water, into 1 to 500 times its weight of liquid, preferably water. Such dissolution may occur for instance in hand laundry applications as well as by other means such as in a washing machine.

By "washing", it is to be understood herein that the fabrics are contacted with a conventional detergent composition, preferably comprising at least one surface active agent in an aqueous bath, this washing may occur by means of a washing machine or simply by hands. In a preferred embodiment, the washing step according to the present invention is performed in a washing machine. The conventional laundry detergent may be delivered into the washing machine either by charging the dispenser drawer of the washing machine with the detergent or by directly charging the drum of the washing machine with the detergent. By "conventional laundry detergent" it is meant herein, a laundry detergent composition currently available on the market. Preferably, said conventional laundry detergent comprises at least one surface active agent (surfactant). Said laundry detergent compositions may be formulated as powders, liquids or tablets. Suitable laundry detergent compositions are for example DASH futur®, DASH essential®, DASH liquid®, ARIEL tablets® and other products sold under the trade names ARIEL® or TIDE®.

More specifically, the process of bleaching fabrics according to the present invention comprises the steps of first contacting said fabrics with a liquid bleaching composition as described herein, in its diluted form, then allowing said fabrics to remain in contact with said composition, for a period of time sufficient to bleach said fabrics, typically 1 to 60 minutes, preferably 5 to 30 minutes, then rinsing said fabrics in water. If said fabrics are to be washed, said washing may be conducted together with the bleaching of said fabrics by contacting said fabrics at the same time with a bleaching composition according to the present invention and said detergent composition, or said washing may be conducted before or after that said fabrics have been bleached. Accordingly, the process according to the present invention allows to bleach fabrics and optionally to wash fabrics before the step of contacting said fabrics with the liquid bleaching composition as described herein and/or in the step where said fabrics are contacted with the bleaching composition and/or after the step where said fabrics are contacted with the bleaching composition and before the rinsing step, and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 60 minutes, preferably 1 minute to 15 minutes and then rinsing said fabrics with water. If said fabrics are to be washed, said washing may be conducted before or after that said fabrics have been bleached. In the embodiment of the present invention wherein the liquid bleaching composition of the present invention, is contacted to the fabrics in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics. It is preferred to perform the bleaching processes herein before said fabrics are washed.

Alternatively, instead of following the neat bleaching process as described herein above (pretreater application) by a rinsing step with water and/or a conventional washing step, the bleaching pre-treatment operation may also be followed by the diluted bleaching process as described herein before either in bucket (hand operation) or in a washing machine.

The temperatures at which the bleaching process herein is performed, do have an influence on the stain removal performance delivered. More specifically, an increased temperature accelerates the bleaching process, i.e. diminishes the time required to bleach a given soil. Typically, the bleaching solutions occurring in the bleaching processes according to the present invention where the bleaching compositions herein are used in their diluted form have a temperature of from 4° C. to 60° C., preferably from 10° C. to 50° C. and most preferably from 5° C. to 30° C.

The compositions of the present invention can be packaged in a variety of containers including conventional bottles, bottles equipped with roll-on, sponge, brusher or sprayers. Also as the aqueous compositions herein are chemically stable, they may be packaged in a given deformable container/bottle without compromising the stability of said container/bottle comprising it upon standing, for long periods of time.

Stain Removal Performance/Bleaching Performance Test Method

The stain removal and/or bleaching performance of a given composition on a soiled fabric, may be evaluated by the following test method.

The fabrics are washed according to common washing conditions with a conventional detergent composition, at a temperature of from 30° C. to 70° C.; then an aqueous composition according to the present invention is added to the prewash or $2^{nd}$ rinse cycle, left to act for a period of time sufficient to bleach said fabric from typically 5 to 45 minutes, then the fabrics are rinsed.

For example, typical soiled fabrics to be used in this test method may be commercially available from EQUEST Company, (Newcastle upon tyne, UK), such as clay, chocolate, spaghetti sauce, make-up, lipstick, tea, coffee, red wine, bacon grease, burnt butter, carrot juice, grass and mud, curry, spinach on substrate/fabric, e.g., knitted cotton (CW120).

The stain removal/bleaching performance may then be evaluated by analyzing washed stain set with unwashed reference swatch via Image Analysis. Image Analysis measures percentage stain removal versus the unwashed stain reference (e.g., the same composition without the soil suspending agent according to the present invention). Once all replicates for all products have been analyzed, an average percentage stain removal and Least Significant Difference is calculated for each stain and product tested. Significant differences between products are calculated to a confidence level of 95%.

The whiteness performance of our composition is tested with the Global Realistic Item Test (GRIT) to technically evaluate product performance on consumer realistic items and body soils. The whiteness performance is then be evaluated by visual grading scale. A visual grading scale is used to assign differences in panel score units (psu), in a range from 0 to 4 (a range of 0 indicates that there is no difference, a range of 4 indicate important differences).

The present invention will be further illustrated by the following examples.

EXAMPLES

The following compositions were made by mixing the listed ingredients in the listed proportions (weight % unless otherwise specified).

| Compositions | I | II | III | IV | V | VI | VII |
|---|---|---|---|---|---|---|---|
| Sodium hypochlorite | 4.5 | 3.0 | 3.0 | 2.5 | 3.0 | 1.0 | 3.0 |
| Sodium hydroxide | 1.0 | 1.4 | 1.0 | 0.5 | 1.4 | 1.0 | 1.4 |
| Sodium carbonate | 1.7 | 1.0 | 1.7 | 0.5 | 1.0 | 1.7 | 1.0 |
| Na $C_{12}/C_{14}$ E3S | — | — | — | — | 1.4 | 2.0 | 2.3 |
| $NaC_{12/14}S$ | — | — | — | — | 0.1 | 0.2 | 0.1 |
| C12/14dimethyl amine oxide | — | — | — | — | — | — | — |
| EHDQ | 0.2 | 0.2 | 0.1 | — | 0.5 | — | 0.2 |
| TS EHDQ | — | 0.1 | 0.1 | 0.2 | — | 0.5 | — |
| Minors and water | | | balance up to 100% | | | | |

The pH of these examples is 8 or above.

| Compositions | VIII | IX | X | XI | XII | XIII | XIV |
|---|---|---|---|---|---|---|---|
| Sodium hypochlorite | 4.5 | 3.0 | 3.0 | 2.5 | 3.0 | 1.0 | 3.0 |
| Sodium hydroxide | 1.0 | 1.4 | 1.0 | 0.5 | 1.4 | 1.0 | 1.4 |
| Sodium carbonate | 1.7– | 1.0 | 1.7 | 0.5 | 1.0 | 1.7 | 1.0 |
| Na $C_{12}/C_{14}$ E3S | — | — | — | — | 1.4 | 2.0 | 2.3 |
| $NaC_{12/14}S$ | — | — | — | — | 0.1 | 0.2 | 0.1 |
| C12/14dimethyl amine oxide | — | — | — | — | — | — | — |
| EHDQ | — | — | 0.4 | 0.2 | — | 0.05 | 0.2 |
| TS EHDQ | 0.2 | 0.5 | 0.1 | — | 0.3 | 0.05 | 0.2 |
| Minors and water | | | balance up to 100% | | | | |

The pH of these examples is 8 or above.

| Compositions | XV | XVI | XVII | XVIII | XIX | XX | XXI |
|---|---|---|---|---|---|---|---|
| Sodium hypochlorite | 4.5 | 3.0 | 3.0 | 2.5 | 3.0 | 1.0 | 3.0 |
| Sodium hydroxide | 1.0 | 1.4 | 1.0 | 0.5 | 1.4 | 1.0 | 1.4 |
| Sodium carbonate | 1.7– | 1.0 | 1.7 | 0.5 | 1.0 | 1.7 | 1.0 |
| Na $C_{12}/C_{14}$ E3S | 0.1 | — | — | — | 0.1 | — | — |
| $NaC_{12/14}S$ | — | 0.1 | — | — | — | — | — |
| C12/14dimethyl amine oxide | — | — | 0.1 | — | — | 1.0 | 2.0 |
| EHDQ | — | — | 0.4 | 0.2 | — | 0.05 | 0.2 |
| TS EHDQ | 0.2 | 0.5 | 0.1 | — | 0.3 | 0.05 | 0.2 |
| Minors and water | | | balance up to 100% | | | | |

The pH of these examples is 8 or above.

Na C12/C14 E3S is C12-C14 Sodium alkyl (ethoxy) 3 sulphate.

NaC12/14S is C12-C14 Sodium alkyl sulphate.

EHDQ is 24-Ethoxylated Hexamethylene Diamine Quaternized

TS EHDQ is trans-sulphated 24-Ethoxylated Hexamethylene Diamine Quaternized

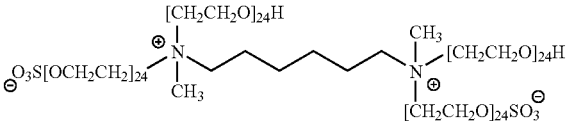

TS EHDQ

Excellent stain removal performance is obtained on a variety of stains including clay/mud stains, food greasy stains, carotenoid-type stains like spaghetti sauce, bleachable stains like tea and enzymatic stains like grass, when treating soiled fabrics with any of the compositions I to XXI, as described above.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A chemically stable bleaching composition comprising, based on active halide, from 0.1% to 10% by weight of the composition of sodium hypochlorite bleach and from about 0.1% to 5% by weight of the total composition of a soil suspending agent that is an ethoxylated diamine having the formula:

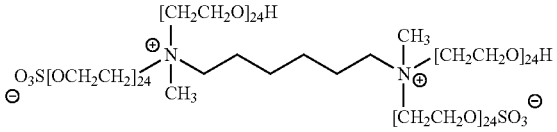

wherein the composition is a liquid.

2. A composition according to claim 1 wherein said sodium hypochlorite bleach, based on active halide, is present in an amount of from about 0.5% to about 6% by weight of the liquid composition.

3. A composition according to claim 1 which comprises from about 0.1% to about 2% by weight of the total composition of said soil suspending agent.

4. A composition according to claim 1 which comprises from about 0.1% to about 0.5% by weight of the total composition of said soil suspending agent.

5. A composition according to claim 1 wherein said composition is a liquid aqueous composition.

6. A composition according to claim 1, which has a pH from about 8 to about 14.

7. A composition according to claim 1, which has a pH from about 9 to about 13.5.

8. A composition according to claim 1 which comprises an optional ingredient selected from the group consisting of pH buffering components, surfactants, polymers, pigments, optical brighteners, solvents, stabilizing agents, hydrotropes, perfumes, latex and the like.

9. A process of bleaching a fabric, with a composition according to claim 1, said process comprising the steps of applying said composition, in its neat form, in its diluted form, or in its dissolved or dispersed form, onto at least a portion of said fabric, for a period of time sufficient to bleach said fabric, before said fabric is washed and/or rinsed.

10. A process according to claim 9 wherein said fabrics are washed before the step of contacting said fabrics with said bleaching composition, and/or in the step where said fabrics are contacted with said bleaching composition, and/or after the rinsing step when said bleaching composition has been removed.

* * * * *